US010759644B2

(12) United States Patent
Lim et al.

(10) Patent No.: US 10,759,644 B2
(45) Date of Patent: Sep. 1, 2020

(54) DIGITAL TABLE

(71) Applicant: PepsiCo, Inc., Purchase, NY (US)

(72) Inventors: Stephen Lim, Chappaqua, NY (US); Martin Eduardo Broen, New York, NY (US)

(73) Assignee: PepsiCo, Inc., Purchase, NY (US)

( * ) Notice: Subject to any disclaimer, the term of this patent is extended or adjusted under 35 U.S.C. 154(b) by 412 days.

(21) Appl. No.: 15/158,151

(22) Filed: May 18, 2016

(65) Prior Publication Data

US 2016/0340165 A1 Nov. 24, 2016

Related U.S. Application Data

(60) Provisional application No. 62/165,042, filed on May 21, 2015.

(51) Int. Cl.
*B67C 3/20* (2006.01)
*B67C 3/02* (2006.01)
(Continued)

(52) U.S. Cl.
CPC ..... *B67C 3/208* (2013.01); *A47G 19/2205* (2013.01); *B67C 3/026* (2013.01);
(Continued)

(58) Field of Classification Search
CPC ..... B67D 1/06; B67D 1/0888; B67D 1/1272; B67D 2001/0811; B67C 3/208; B67C 3/026; B67C 3/264; A47G 19/2205; A47G 19/2227; A47G 19/2255; B65D 1/06; A47B 7/00
(Continued)

(56) References Cited

U.S. PATENT DOCUMENTS 166,874 A * 8/1875 Hood ..... A47B 9/16 108/116
2,022,591 A * 11/1935 Everitt ..... A47B 31/00 108/24
(Continued)

FOREIGN PATENT DOCUMENTS

CN 1141003 A 1/1997
CN 101394768 A 3/2009
(Continued)

OTHER PUBLICATIONS

Our Egyptian Furniture, Nora Scott, The Metropolitan Museum of Art, pp. 129-152, Dec. 1965.*
(Continued)

*Primary Examiner* — Andrew D Stclair
(74) *Attorney, Agent, or Firm* — Sterne, Kessler, Goldstein & Fox, P.L.L.C.

(57) ABSTRACT

The disclosure concerns a dispensing system, having at least one dispense location with at least one dispensing head configured to dispense a beverage through a bottom portion of a container. In one aspect, the dispensing head may dispense a plurality of different beverage ingredients which a user may select to dispense a custom beverage. In another aspect the dispensing system comprises a modular dispensing system having a plurality of dispense locations each connected through piping to a central, remote ingredient system.

20 Claims, 10 Drawing Sheets

(51) Int. Cl.

| | |
|---|---|
| ***B67C 3/24*** | (2006.01) |
| ***B67C 3/26*** | (2006.01) |
| ***B67D 1/06*** | (2006.01) |
| ***A47G 19/22*** | (2006.01) |
| ***B67D 1/12*** | (2006.01) |
| ***B67D 1/08*** | (2006.01) |
| ***B67D 1/00*** | (2006.01) |
| *B65D 1/06* | (2006.01) |
| *B67D 1/07* | (2006.01) |

(52) U.S. Cl.
CPC ..... *B67C 3/24* (2013.01); *B67C 3/264* (2013.01); *B67D 1/0021* (2013.01); *B67D 1/06* (2013.01); *B67D 1/0888* (2013.01); *B67D 1/0894* (2013.01); *B67D 1/1272* (2013.01); *B65D 1/06* (2013.01); *B67D 1/07* (2013.01); *B67D 2001/075* (2013.01); *B67D 2001/0811* (2013.01); *B67D 2210/00015* (2013.01); *B67D 2210/00065* (2013.01)

(58) Field of Classification Search
USPC ..... 239/400, 427.5
See application file for complete search history.

(56) References Cited

U.S. PATENT DOCUMENTS

| | | | | |
|---|---|---|---|---|
| 5,033,651 | A * | 7/1991 | Whigham | B67D 1/0051 222/1 |
| 8,899,281 | B2 | 12/2014 | Russell | |
| 2005/0242957 | A1* | 11/2005 | Lindsay | G06K 19/0716 340/572.7 |
| 2007/0152829 | A1 | 7/2007 | Lindsay et al. | |
| 2008/0223478 | A1 | 9/2008 | Hantsoo et al. | |
| 2008/0277020 | A1 | 11/2008 | Windmiller | |
| 2008/0302711 | A1* | 12/2008 | Windmiller | B65D 1/06 210/137 |
| 2009/0205747 | A1* | 8/2009 | Lillard, Jr. | B67D 1/0888 141/94 |
| 2011/0061764 | A1 | 3/2011 | Springer | |
| 2011/0121020 | A1* | 5/2011 | Springer | B67D 1/1236 222/1 |
| 2011/0168775 | A1 | 7/2011 | Van Zetten | |
| 2011/0187664 | A1* | 8/2011 | Rinehart | G06F 3/041 345/173 |
| 2012/0103926 | A1 | 5/2012 | Ibsies | |
| 2012/0298693 | A1* | 11/2012 | Jersey | B67D 1/0021 222/129.1 |
| 2013/0106690 | A1* | 5/2013 | Lim | G07F 13/065 345/156 |
| 2013/0118639 | A1 | 5/2013 | Springer | |
| 2013/0264360 | A1 | 10/2013 | Astolfi | |
| 2014/0110018 | A1 | 4/2014 | Scarvelli | |
| 2014/0299630 | A1 | 10/2014 | Brown et al. | |
| 2014/0332113 | A1 | 11/2014 | Springer | |

FOREIGN PATENT DOCUMENTS

| | | | |
|---|---|---|---|
| CN | 101588968 | A | 11/2009 |
| CN | 102099251 | A | 6/2011 |
| RU | 2218067 | C2 | 12/2003 |
| WO | WO 9921466 | A1 | 5/1999 |
| WO | 2006055866 | A1 | 5/2006 |
| WO | 2014122260 | A2 | 8/2014 |

OTHER PUBLICATIONS

Exodus 25:26, approximately 500 B.C., accessed at www.esv.org on Mar. 26, 2019.*

Written Opinion and International Search Report of the International Searching Authority issued in International Application No. PCT/US2016/33255, dated Aug. 22, 2016, 9 pages.

Supplementary Partial European Search Report issued in corresponding European Application No. 16797295.9, dated Sep. 25, 2018 (16 pages).

International Preliminary Report on Patentability in International Application No. PCT/US2016/033255, dated Nov. 21, 2017, 8 pages.

* cited by examiner

DIGITAL TABLE

CROSS-REFERENCE TO RELATED APPLICATION(S)

This application claims priority to U.S. Provisional Application No. 62/165,042, filed on May 21, 2015, which is incorporated herein in its entirety by reference thereto.

FIELD OF THE INVENTION

This disclosure relates generally to a beverage dispensing system for the dispensing of beverage ingredients through a bottom portion of a container.

BACKGROUND

Various beverage dispensers, such as those at restaurants, theatres and other entertainment and/or food service venues, typically have either a "drop in" dispenser apparatus or a counter top type dispenser apparatus. In a drop in dispenser apparatus, the dispenser apparatus is self-contained and may be dropped into an aperture of a counter top. In a counter top type dispenser apparatus, the dispenser apparatus is placed on a counter top. In conventional beverage dispensers, a dispensing head is coupled to a particular drink syrup supply source via a single pipe dedicated to supply the particular drink syrup to that dispensing head, wherein the particular drink syrup supply source is typically located near the counter top, i.e., directly under the counter top, or directly over the counter top.

A user will typically place a cup under the signage of the selected beverage and either press a button or press the cup against a dispensing lever to activate the dispenser so that the selected beverage is delivered from the dispensing head corresponding to the selected beverage and into the cup until pressure is withdrawn from the button or lever.

Conventional beverage dispensers are typically limited to dispensing drinks having flavoring supply sources located at their respective counters. Thus, a limited number of drinks are typically available at a conventional beverage dispenser. For example, drinks typically available at a conventional beverage dispenser are a regular cola beverage, a diet cola beverage, perhaps one or several non-cola carbonated beverages, such as a lemon-lime flavored carbonated beverage or some other fruit-flavored drink (e.g., orange flavored carbonated beverage, and/or root beer), and perhaps one more non-carbonated beverage(s), such as a tea and/or a lemonade.

Conventional dispensers are not typically configured to permit a user generate or receive from a single dispensing head a custom-ordered beverage that a consumer may wish to purchase, e.g., a cola flavored with cherry, vanilla, lemon, or lime, etc., or a tea flavored with lemon, orange, peach, raspberry, etc., or a tea having one or more teaspoons of sweetener.

Conventional dispensers typically require a dedicated dispensing head for each particular beverage.

What is needed is a beverage dispensing system that does not have the limitations and disadvantages of conventional beverage dispensers and methods.

SUMMARY

In one embodiment a dispensing system is provided, such as for dispensing beverages including soda.

In an exemplary embodiment, a dispensing system includes a dispense location, such as a table, and a dispensing head configured to dispense a beverage through a bottom portion of a container.

In another exemplary embodiment, the dispensing system may dispense and/or mix a plurality of different beverage ingredients including syrups, flavors, and water. A user may select through a user interface a type of beverage and add different flavor options.

In another exemplary embodiment the dispensing system comprises a modular dispensing system having a plurality of dispense locations each connected through piping to a central, remote ingredient system.

It will be appreciated by those skilled in the art, given the benefit of the following description of certain exemplary embodiments of the dispensing system disclosed herein, that at least certain embodiments disclosed herein have improved or alternative configurations suitable to provide enhanced benefits. These and other aspects, features and advantages of this disclosure or of certain embodiments of the disclosure will be further understood by those skilled in the art from the following description of exemplary embodiments taken in conjunction with the following drawings.

Some embodiments are directed to a dispensing system for bottom filling a container with a beverage, the dispensing system including a controller configured to receive a beverage order from a user and make available a container including an identifier based on the beverage order received from the social media system; a table including a top surface, an ingredient conduit disposed below the top surface and including a plurality of ingredient lines, a dispensing head configured to sealingly engage a recessed portion on the bottom of the container, the dispensing head including one or more outlets for dispensing one or more ingredients received from the one or more ingredient lines into the bottom portion of the container, and a sensor configured to detect the presence of the identifier on the container when the container is sealingly engaged with the dispensing head; and the controller is configured to bottom fill the container with the beverage when the sensor detects the identifier on the container sealingly engaged with the dispensing head.

Some embodiments are directed to a dispensing platform for bottom filling a container with a beverage, the dispensing platform including a top surface; an ingredient conduit disposed below the top surface and including a plurality of ingredient lines; and a dispensing head coupled to the ingredient conduit and extending vertically above the top surface, the dispensing head including a plurality of outlets for dispensing one or more ingredients received from one or more ingredient lines into a bottom portion of the container, where the outlets are arranged vertically on the dispensing head and each of the plurality of ingredient lines is in fluid communication with one of the outlets of the dispensing head.

Some embodiments are directed to a dispensing platform for bottom filling a container with a beverage, the dispensing platform including a top surface; a mixing chamber disposed below the top surface; a dispensing head coupled to the mixing chamber and extending vertically above the top surface, the dispensing head including an outlet for dispensing the beverage into a bottom portion of the container; and an ingredient conduit including a plurality of ingredient lines for delivering ingredients for forming the beverage to the mixing chamber, where the ingredients for the beverage are mixed in the mixing chamber before the beverage is dispensed from the dispensing head.

Some embodiments are directed to a dispensing system for bottom filling a container with a beverage, the dispensing system including a table; a dispensing head disposed on the table and configured to sealingly engage a recessed portion on the bottom of the container, the dispensing head including one or more outlets for dispensing one or more ingredients into the bottom portion of the container; a plurality of user interfaces configured to receive a user's selection of one or more different types of beverages to be dispensed via the dispensing head; and a controller configured to receive the user's selection of one or more different types of beverages to be dispensed via the dispensing head and dispense the one or more different types of beverages from the dispensing head.

DETAILED DESCRIPTION OF THE PREFERRED EMBODIMENTS

Figure 1:
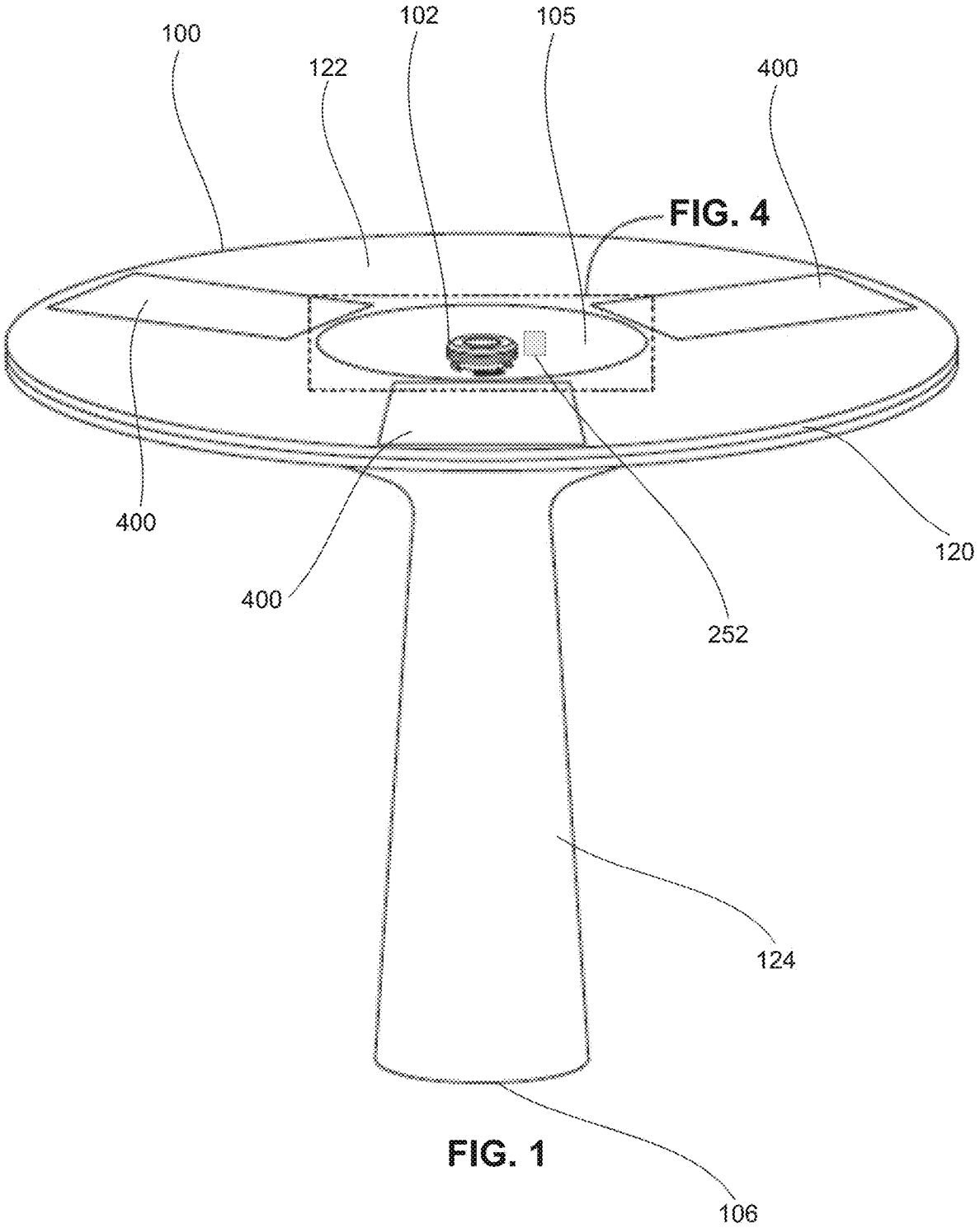
FIG. 1 is perspective view of an embodiment of a dispensing table according to various aspects of the disclosure.

While this invention is susceptible of embodiments in many different forms, there are shown in the drawings and will herein be described in detail exemplary embodiments of the invention with the understanding that the present disclosure is to be considered as an exemplification of the principles of the invention and is not intended to limit the broad aspects of the invention to the embodiments illustrated.

In the following description of the various embodiments, reference is made to the accompanying drawings, which form a part hereof, and in which is shown by way of illustration, various embodiments of the disclosure that may be practiced. It is to be understood that other embodiments may be utilized.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

In general, aspects of this invention relate to dispensing systems. According to various aspects and embodiments, the dispensing systems may be formed of one or more of a variety of materials, such as metals (including metal alloys), plastics, polymers, and composites, and may be formed in one of a variety of configurations, without departing from the scope of the invention.

The various figures in this application illustrate examples of dispensing systems according to this disclosure. When the same reference number appears in more than one drawing, that reference number is used consistently in this specification and the drawings refer to the same or similar parts throughout.

The embodiments discussed below may be used to form a wide variety of beverages, including but not limited to cold and hot beverages, and including but not limited to beverages known under any PepsiCo branded name, such as Pepsi-Cola®.

A dispensing system 50 according to aspects of this disclosure is shown in at least FIGS. 1-8. Dispensing systems 50 according to aspects of this disclosure may be used to dispense liquids including beverages such as carbonated beverages including soda. The dispensing system 50 can generally include one or more dispense locations 100, which may be tables, counters, or other surfaces. Each dispense location 100 may include at least one dispensing head 102 configured to dispense a liquid substantially through a bottom portion of a container (e.g., a cup, a bottle, or the like) 200. The dispensing system 50 can also include one or more containers 200 configured to engage with the dispensing head 102 and receive liquid from the dispensing head 102 through the bottom or lower portion of the container 200. Each of the dispense locations 100 may also include one or more user interface screens 400 that may be used by a user to select the type of liquid or beverage to be dispensed and/or combinations of beverage ingredients such that a user may select a custom beverage. The dispensing system 50 may also be a modular system having a plurality of dispense locations 100 each connected to a central ingredient system 300.

As described above, the dispensing system 50 may also include an ingredient system 300 located remotely from the dispense location(s) 100 and connected to the dispense location 100 by piping 301. The ingredient system 300 is configured to supply the dispense location(s) 100 with beverage ingredients such as water, syrup, and flavorings. In some embodiments the dispensing system may include multiple dispense locations 100 each connected by piping 301 to a common ingredient system 300.

Dispense Location and Container

Figure 2A:
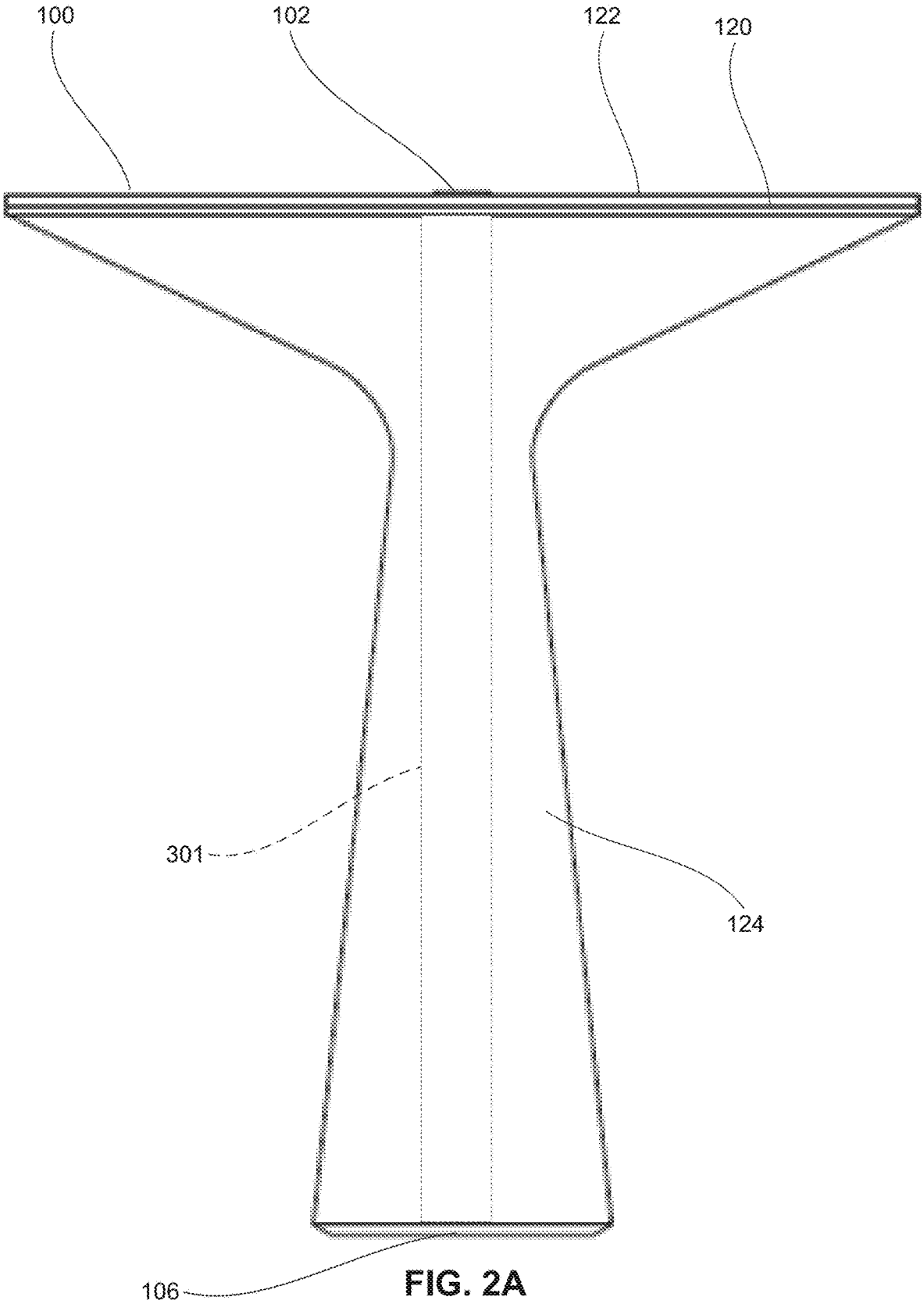
FIG. 2A is a side view of an embodiment of the dispensing table of FIG. 1.
Figure 2B:
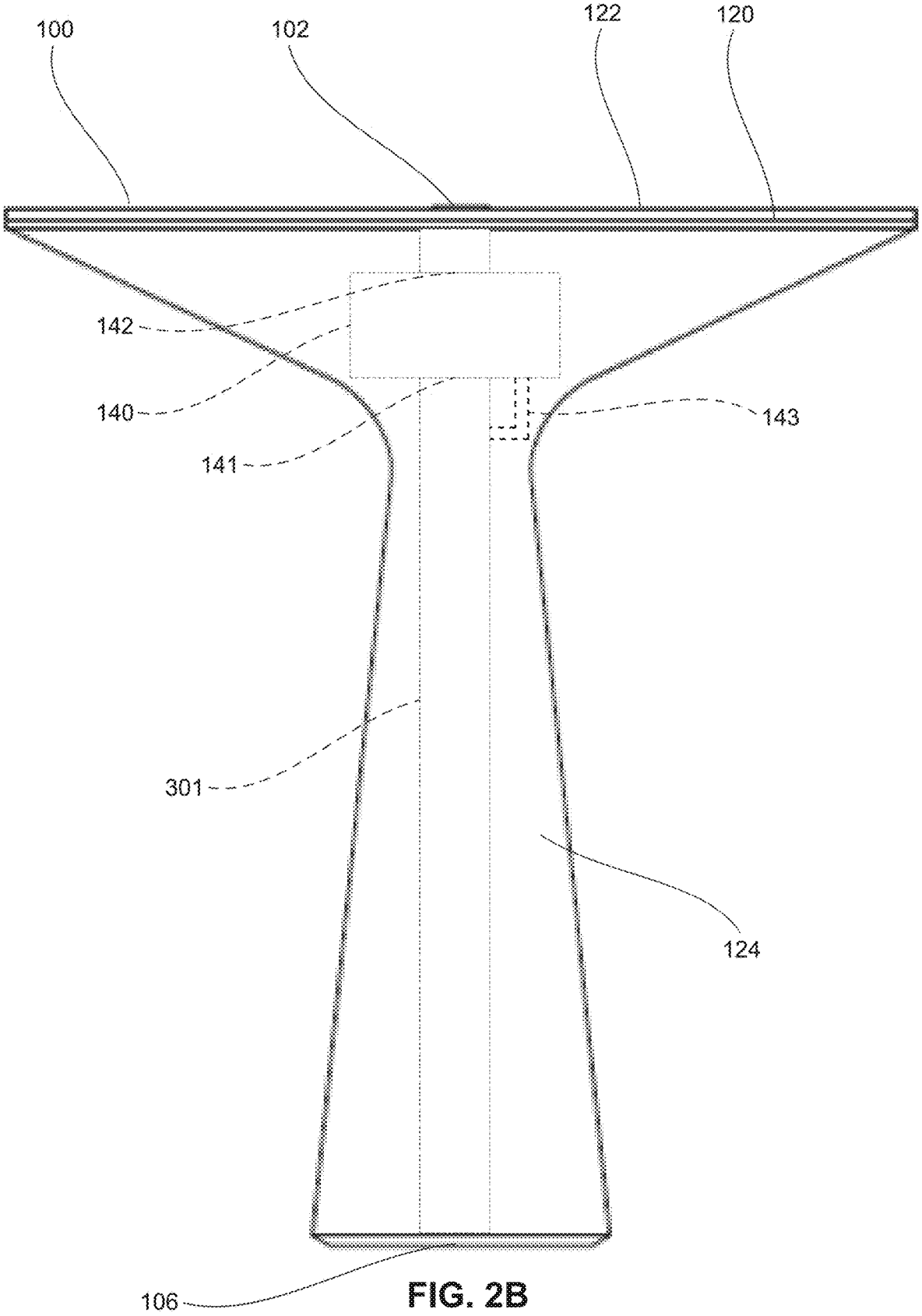
FIG. 2B is a side view of an embodiment of the dispensing table of FIG. 1.
Figure 3:
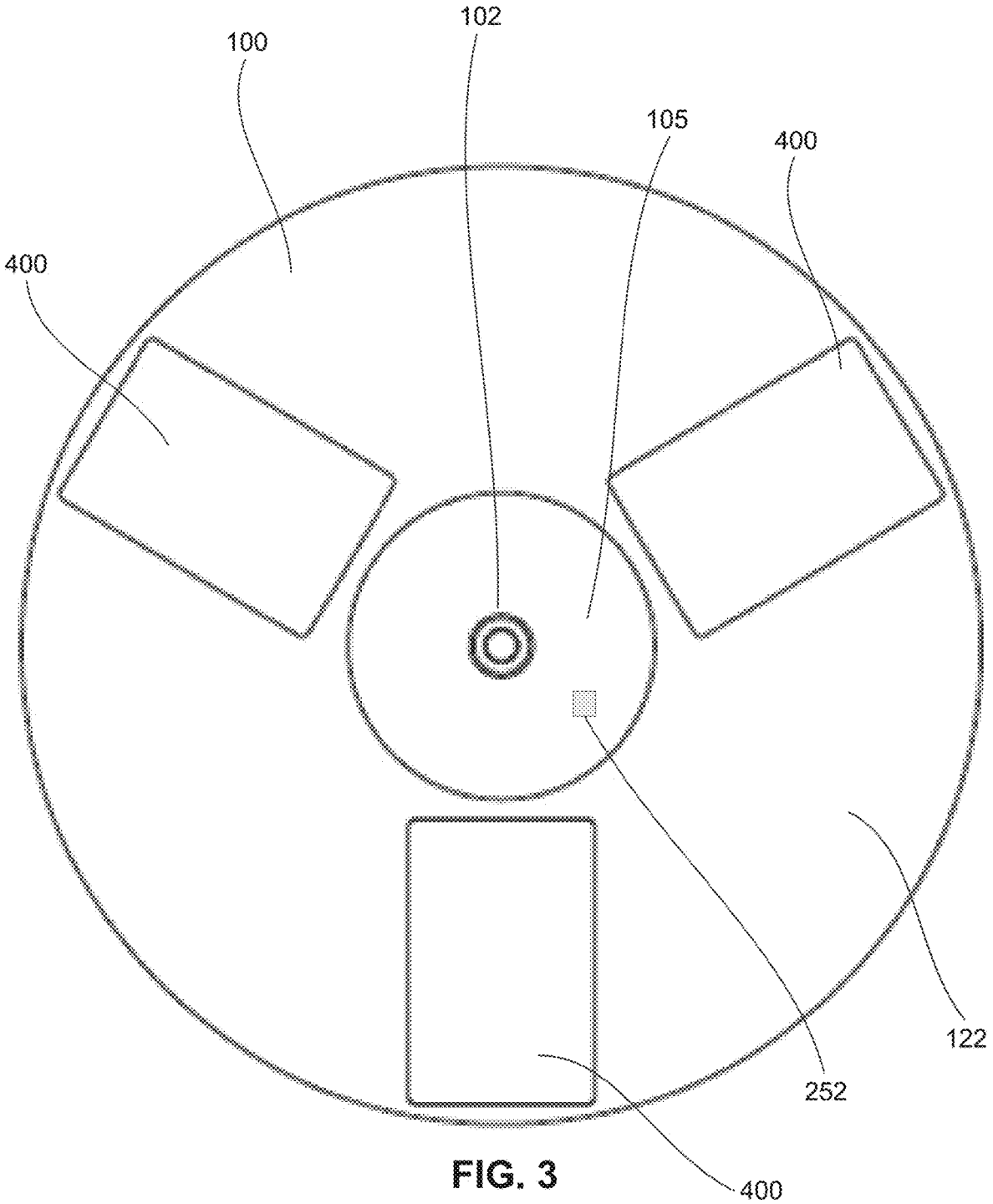
FIG. 3 is a top view of an embodiment of the dispensing table of FIG. 1.

Referring to FIGS. 1-3, the dispense location 100 may comprise a table, counter, or other surface. In some embodiments, dispense location 100 may include a table top 120 having a top surface 122. In some embodiments, dispense location 100 may include a support structure 124 for supporting table top 120. Each dispense location 100 may include at least one dispensing head 102 configured to dispense liquid into a bottom or lower portion of a container 200. Each dispense location 100 may also include one or more user interfaces 400, through which a user may select one or more different types of beverages and/or beverage combinations to create a custom beverage. The dispense location 100 may also include a declined surface 105 with a drain 107 at the bottom of the declined surface. Additionally, as will be discussed in greater detail below, the dispense location 100 may also include a connection point 106 which may be used to connect the dispense location 100 to the ingredient system 300 and/or piping 301.

Figure 4:
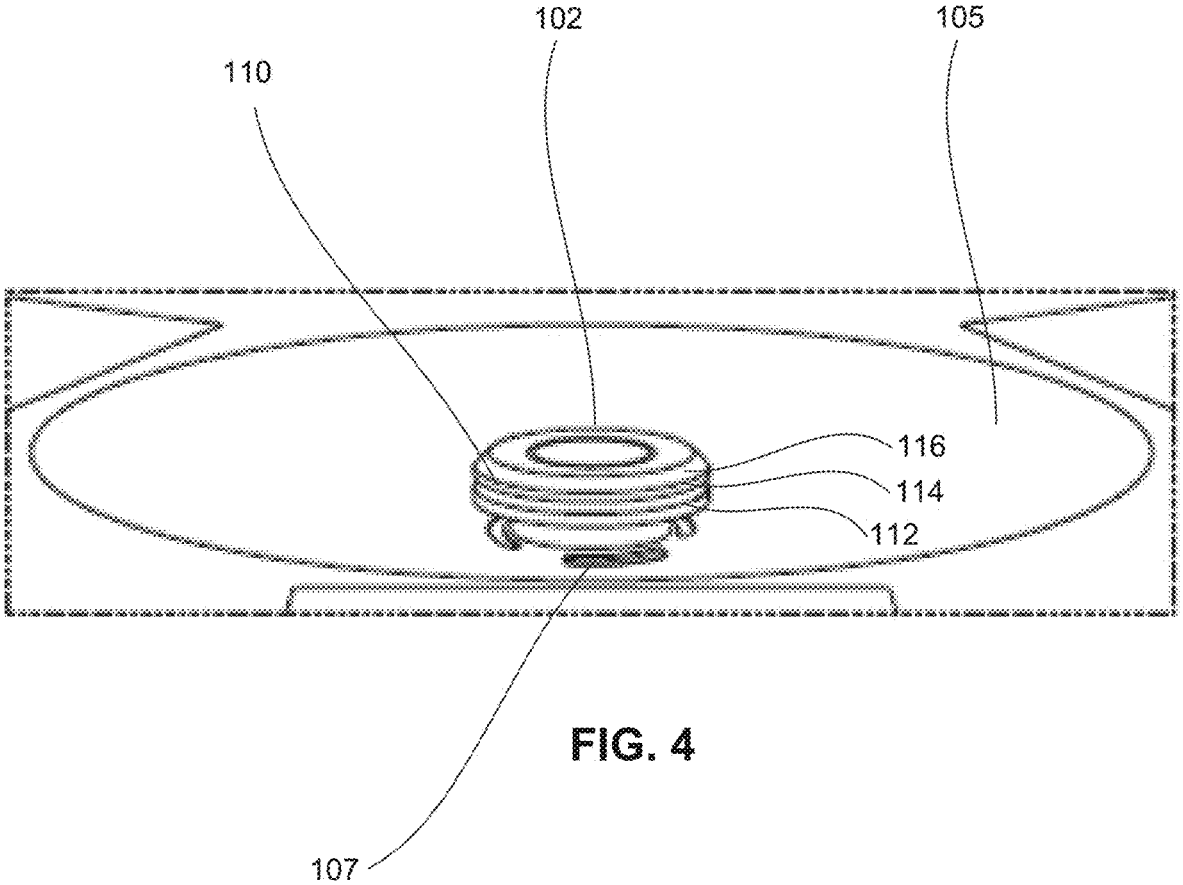
FIG. 4 is a detail perspective view of an embodiment of the dispensing head shown in FIG. 1.

The dispensing head 102 can be a raised portion which can, as shown in FIG. 4, be generally cylindrically shaped. However, the dispensing head 102 can be any suitable size or shape. As will be discussed below, the dispensing head 102 can be sized and shaped to couple to a bottom portion 202 of a container 200.

The dispensing head 102 can include one or more nozzles or dispensing points (i.e., outlets) 110. Each dispensing point 110 can be configured to inject a certain type of beverage and/or beverage ingredient into container 200. In some embodiments a single nozzle can be used to inject multiple beverage ingredients.

In some embodiments, as shown in FIG. 2B, the dispensing system 50 may include one or more mixing chambers 140. As will be discussed in greater detail below, beverage ingredients may be supplied to the mixing chamber(s) 140 from the ingredient system 300 and/or piping 301. Any beverage ingredients may be added to the mixing chamber 140. For example, a beverage of regular Pepsi-Cola®, may be formed in mixing chamber 140. The mixing chamber 140 may include beverage ingredient inlets 141 and a mixed beverage outlet line 142 which is in fluid communication with the dispensing head 102. After being mixed in the mixing chamber 140, the mixture exiting mixing chamber 140 in beverage outlet line 142 may have a ratio of beverage ingredient (or syrup) to water of about 5 to 1 by weight.

Mixing chamber 140 may also include a post rinse system capable of substantially rinsing the mixing chamber after dispensing a beverage. After a fluid is dispensed through the dispensing head 102, a fluid or other rinsing material may enter the mixing chamber 140 to rinse the mixing chamber and substantially eliminate colorings and/or flavorings. The mixing chamber 140 may also include a drain 143 to drain rinsing material from the mixing chamber 140 once rinsing is complete.

As described above, the dispensing head 102 is configured to dispense one or more types of beverages and/or one or more types of beverage ingredients. In another embodiment, as shown primarily in FIGS. 2A and 4, the dispense location 100 may not include a separate mixing chamber and mixing of ingredients may occur at the dispensing head 102 and/or in the container 200. In one embodiment, for example, the dispensing head 102 can include at least three separate dispensing points 110. The dispensing points 1 10 may be placed vertically above each other. For example, in one embodiment the dispensing system may include a first dispensing point 112, a second dispensing point 114 above the first dispensing point 112, and a third dispensing point 116 above the second dispensing point. In one example the first dispensing point 112 may be configured to dispense soda flavoring, such as a flavor shot; the second dispensing point 114 may be configured to dispense a product or soda syrup; and the third dispensing point 116 may be configured to dispense water or carbonated water. In such a system, the dispensing points 112, 114, and 116 may be configured to mix the separate beverage components within the container 200. Additionally, the dispensing points 112, 114, and 116 may be configured such that the liquid from the highest or third or dispensing point 116 may rinse the first and second dispensing points 112, 114 once a container 200 is removed from the dispensing head 102.

In some embodiments the dispense locations 100 may include an ultraviolet cleaning device (not shown) which may be used clean, such as by killing and/or inactivating microorganisms, on the dispense location 100 particularly near the dispensing head 102.

The dispense location can also include a refrigeration unit (not shown) or heating unit (not shown) to cool or heat beverage ingredients provided to the dispense location 100.

Figure 5A:
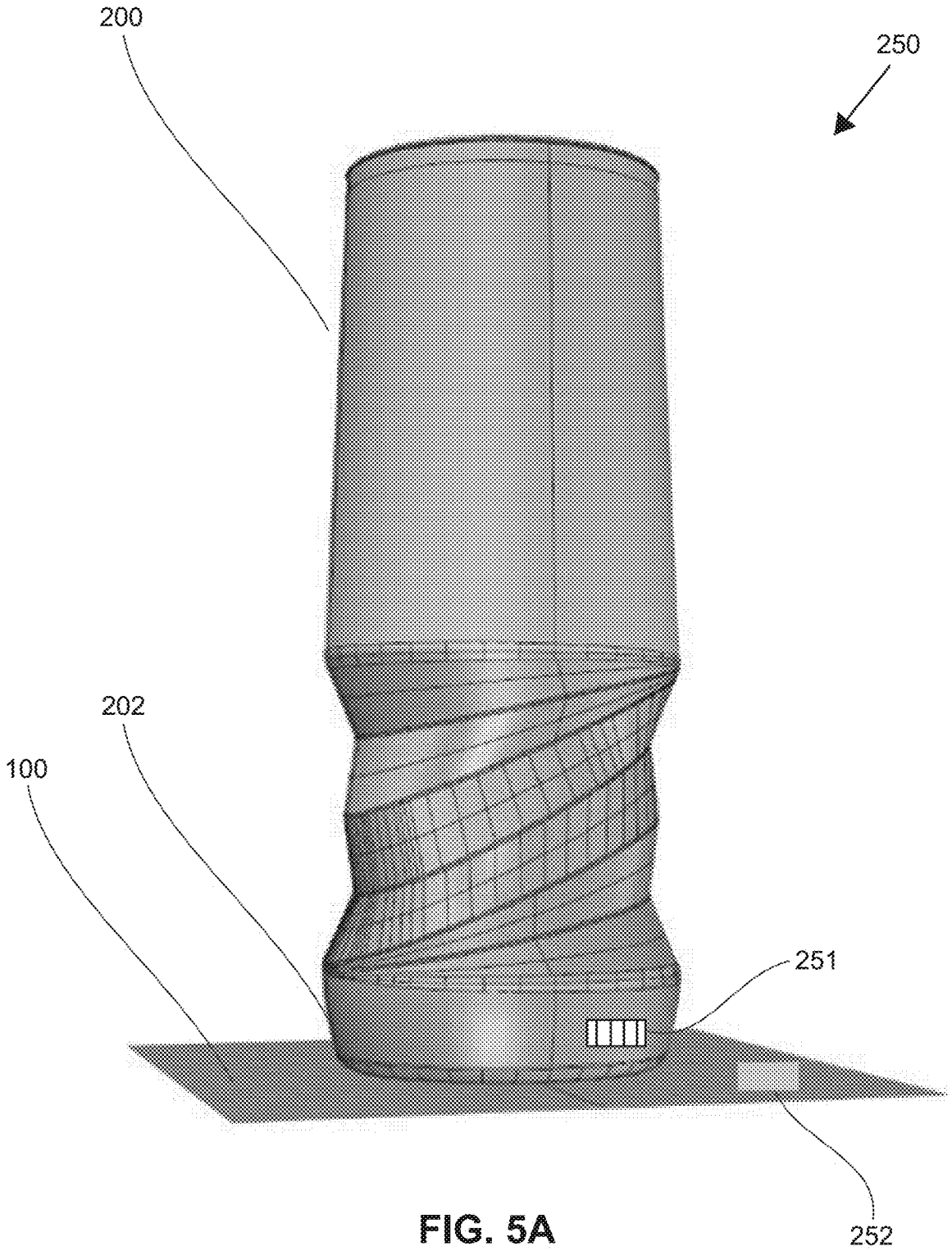
FIG. 5A is a perspective view of a container for use with a dispensing table according to aspects of the disclosure.
Figure 5B:
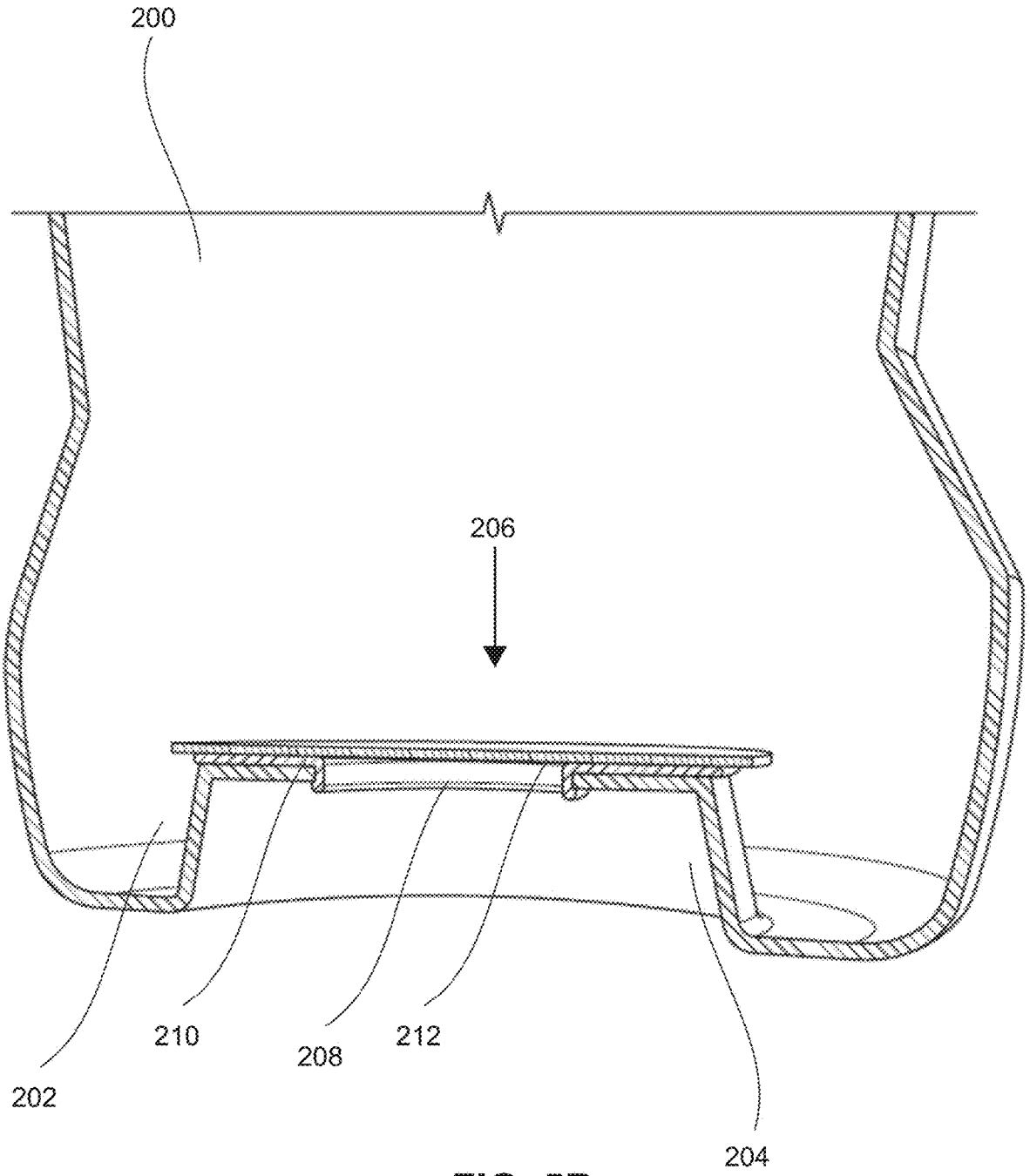
FIG. 5B is a cross-sectional schematic view of a lower portion of a container for use with a dispensing table according to aspects of the disclosure.

Referring now to FIGS. 4, 5A, and 5B, the dispensing head 102 is configured to engage or couple to a container 200 at a bottom portion 202 of the container 200 such that a beverage may be dispensed generally into a bottom portion 202 of the container 200. The container 200 can be any type of container generally configured to hold liquids such as a glass, cup, mug, bottle, etc. As will be discussed below, the container 200 may include a recessed portion 204 in the bottom portion 202 of the container 200 configured to receive the dispensing head 102.

To dispense a beverage from the dispensing head 102, a user couples the container 200 to the dispensing head 102 by placing the container on top of the dispensing head 102. The container 200 may include a dispensing head entrance system 206 which may have any number of different configurations which allow the dispensing head 102 to dispense liquid into the container 200 and then seal the container 200 once the container 200 is removed from the dispensing head 102. In one embodiment as shown in FIG. 5 the recessed portion 204 may include an aperture 208 through which the dispensing head 102 or a portion of the dispensing head 102 may be inserted. The dispensing head entrance system 206 may include a first engagement surface 210 that may generally form a ring or portion of a ring around the aperture 208. The dispensing head entrance system 206 may also include a second engagement surface 212 forming a surface capable of covering the aperture 208 and engaging with the first engagement surface 212. The first and second engagement surfaces 210, 212 may be biased towards each other such that when the dispensing head 102 is not coupled to the container 200, the first and second engagement surfaces 210, 212 generally form a liquid-tight seal such that liquid may not exit through the bottom portion 202 of the container. The first and second engagement surfaces 210, 212 may be biased towards each other using magnets, springs, and any other suitable devices. In some embodiments the first and second engagement surfaces may be biased towards each other simply through gravity.

As the container 200 is engaged with the dispensing head 102 it causes the first and second engagement surfaces 210, 212 to separate creating a path for liquid to flow from the dispensing head 102 into the container 200.

The dispensing head 102 may be manually operable such that when a user places a container 200 on the dispensing head 102 liquid is injected into the container 200 until the user removes the container 200 from dispensing head. In such a system, the dispensing head 102 and/or dispense location 100 may include a lever or other device capable of sensing when the container 200 is coupled to the dispensing head 102. In other embodiments, however, the dispensing head 102 can automatically fill the container to a predetermined level.

In some embodiments, the container 200 may include an identifier, so that various advantageous processes may be realized. An example container identification system 250 may include the container 200 and the dispense location 100. In some embodiments, container 200 may include an identifier 251 so that it may be recognized by the dispense location 100. The dispense location 100 may have a sensor 252 to detect the presence and/or identify the container 200. In some embodiments, sensor 252 may be a mutual capacitive sensor and include support for multi-touch detection. Sensor 252 may be positioned in various locations, depending on the embodiment. In some embodiments, the sensor 252 may be positioned, within or affixed to the declined surface 105. In other embodiments, the sensor 252 may be positioned or affixed to the dispensing head 102, and in still other embodiments, the sensor 252 may be engaged with the dispense location 100 at any suitable location. Sensor 252 may be positioned so that the identifier 251 may be read when container 200 is placed in a dispensing position. In other embodiments, sensor 252 may be positioned in various other locations such that the user may swipe or hold container 200 near the sensor 252 before dispensing beverage.

In some embodiments, identifier 251 may include conductive printing and/or semiconductors capable of communications over various frequencies, using various protocols, on container 200 in a pattern that may be read by the sensor 252. In other embodiments, the identifier 251 may be an RFID.

In some embodiments, the conductors may include conductive ink. In various embodiments, the conductors may be printed on the bottom of container 200, in between layers of container material, a surface of container 200 or on a sticker that may be affixed to container 200. The printed conductors may be visible or visible markings may be added, so that the user may recognize the presence of the printed conductors. For example, visible markings may contain a message to the user conveying information about a feature associated with container 200, such as "two-drink limit" or "unlimited drinks". In some embodiments, the marking may be artwork or graphics.

In various embodiments, a range of numbering or identification methods may be used to provide a unique identifier 251 for each container 200. For example, one skilled in the art would appreciate that a dot or line pattern may be used, such as is found in common bar codes. Alternatively, numeric print may be used. A series of letters or other shapes may be used. Any pattern or geometry recognizable by sensor 252 and containing a sufficient number of unique arrangements may be used.

In some embodiments, the ink of the printed conductors may wash away or become otherwise unrecognizable when exposed to condensation or moisture. This feature may be used to provide a one-time use container where condensation may wash away the ink during first use of the container so that it can no longer be read by sensor 252. Dispense location 100 may not dispense beverage to a container that cannot be identified.

The identification system 250 including the identifier 251 and the sensor 252 may be used in various filling operations. For example, the sensor 252 and identifier 251 can be used in an automatic filling operation such that the dispensing head 102 dispenses a predetermined amount of beverage associated with a size of the container 200 identified with the identifier 251.

User Interface

Figure 6:
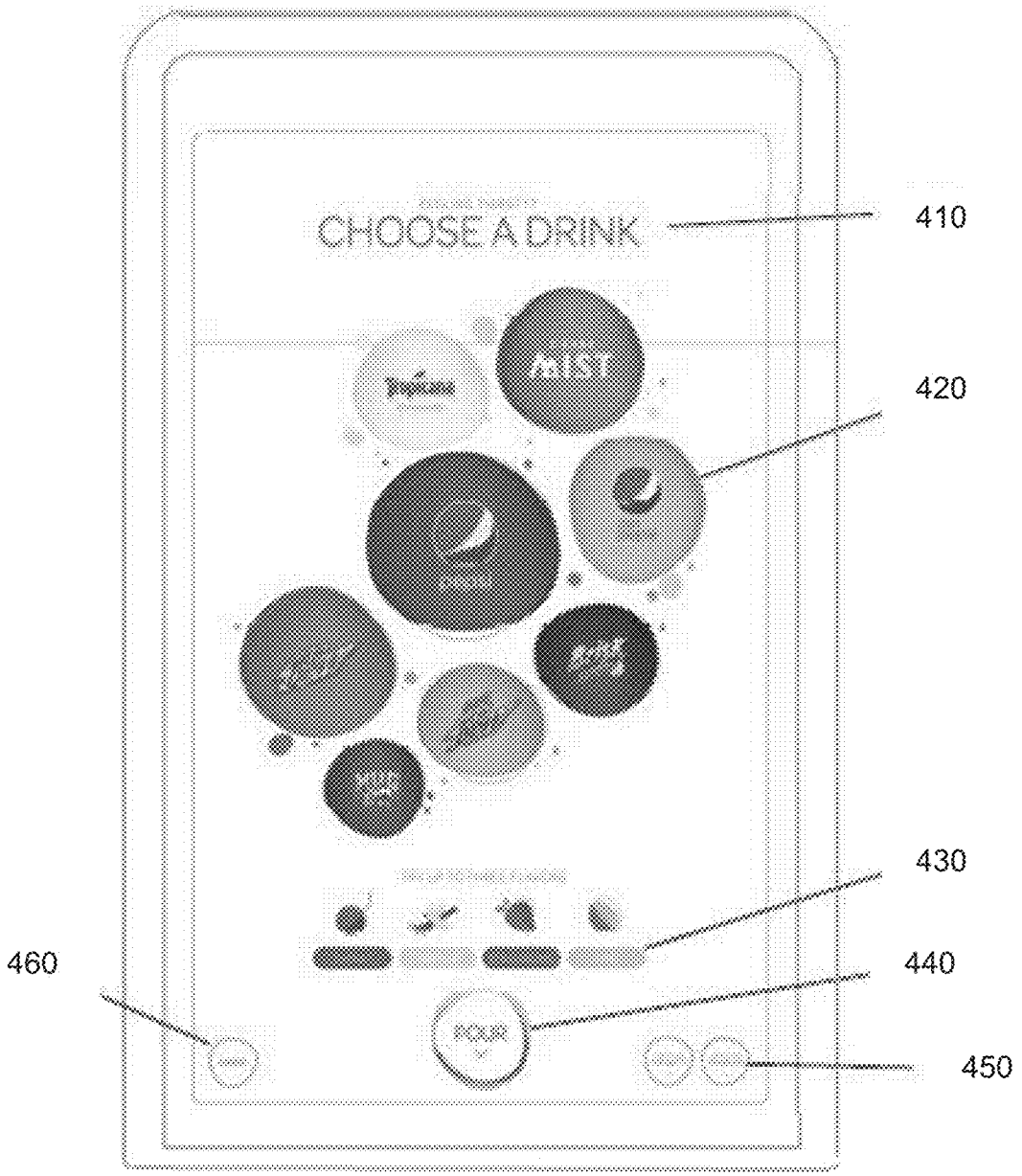
FIG. 6 is an example user interface display according to aspects of the disclosure.

As described above, each dispense location 100 may include one or more user interfaces 400. As shown for example in FIGS. 1 and 3, the dispense location 100 may include three user interfaces 400. The user interface 400 may be a touch display or any other suitable system. FIG. 6 depicts one of the many possible arrangements, given the disclosure herein. In some embodiments, the user interface 400 may include a title area or title screen 410 where graphics, text or other visual information may be placed in order to invite a consumer to make various selections. The user interface 400 may include various beverage options which a user may select. In some embodiments, the user interface 400 may include various beverage options 420 and various flavor or ingredient addition or removal options 430. Some embodiments may include dispensing commands such as pour selection 440, various water dispensing selections 450 and a cancel selection 460.

The user interface 400 may be a touch sensitive panel and may be constructed of various layers, including one or more glass layers, electrode layers, insulating material and adhesives. User interface 400 may support one or more touch sensitive areas, enabling user interaction via touch within those areas.

As will be discussed in more detail below, the beverage dispensing system 50 may include one or more control units 500 which may be interfaced with user interface 400 to receive touch actions from user interface 400 and to perform other actions, for example, control unit 500 may control the dispensing system 50 to dispense beverages from the dispensing head 102 as selected by a user.

Control unit 500 may manage the operation of user interface 400. Control unit 500 may include one or more processors, memory and/or discrete logic. In some embodiments, control unit 500 may include a clock, calendaring software, interface to sensors, such as beverage availability or other stock levels. Control unit 500 may be connected to user interface 400 to operate the touch panel and to receive user input from user interface 400. For example, in some embodiments, control unit 500 may receive coordinates representing a location on the user interface touched by a user.

In some embodiments, the user interface 400 may be controlled to direct or lead a user through an interaction to select a beverage. For example, artwork or graphics (objects) associated with available beverage options 420 may first be shown on the user interface 400. Next, flavoring options 430 may be shown on the user interface 400. Finally, a "Pour" or "Fill" object may be shown on the user interface 400 to alert the user that the beverage dispensing process has progressed to the final stage and the beverage may be dispensed.

In some embodiments, user interface 400 may be configured based on availability of a beverage product/syrup or a flavoring. For example, should a flavoring be unavailable, control unit 500 may control the user interface to not show objects related to that flavoring.

The user interface 400 may include multiple screens. For example, some screens may provide images related to carbonated beverages while another layer may provide images related to juices.

In some embodiments, the user interface 400 may be configured based on the time of day. For example, during morning hours, control unit 500 may control the user interface 400 to show objects related to juices while during afternoon or evening hours, control unit 500 may control user interface 400 to show objects related to carbonated beverages.

In some embodiments, a proximity sensor may be used to detect the presence of a user. The proximity sensor may include an optical sensor. In some embodiments, the behavior of user interface 400 may change, depending on the presence of a user. For example, when no user is detected nearby, the user interface may enter an "attract" mode wherein the user interface may use illumination or sound to attract the attention of an un-engaged, or not yet engaged, user. In another example, when a user is detected in proximity, the user interface may enter a "ready" mode where it may be responsive to an initial user input.

When a user selects an object in the user interface 400, various other portions and/or screens of the user interface may be shown. For example, a first screen providing beverage options 420 may be provided. Once a beverage has been selected, various other portions and/or screens may be provided to indicate a valid next selection for the user. For example, a "pour" option and/or screen may be shown or a flavor addition option 430 may be shown to indicate to the user that either of these portions are valid next selections.

The user interface 400 may timeout in some embodiments, so that user input may no longer be accepted from certain areas and the interface may reset to an initial state.

In some embodiments, the interface 400 may include a "cleaning" mode wherein the interface 400 may become unresponsive to input for a predetermined period, such as 15 seconds. The "clean" mode disables user inputs to facilitate wiping or otherwise touching of the user interface for cleaning, without dispensing beverages. At the expiration of the predetermined period, the interface may exit the "cleaning" mode and return to normal operation.

Ingredient System

Figure 7:
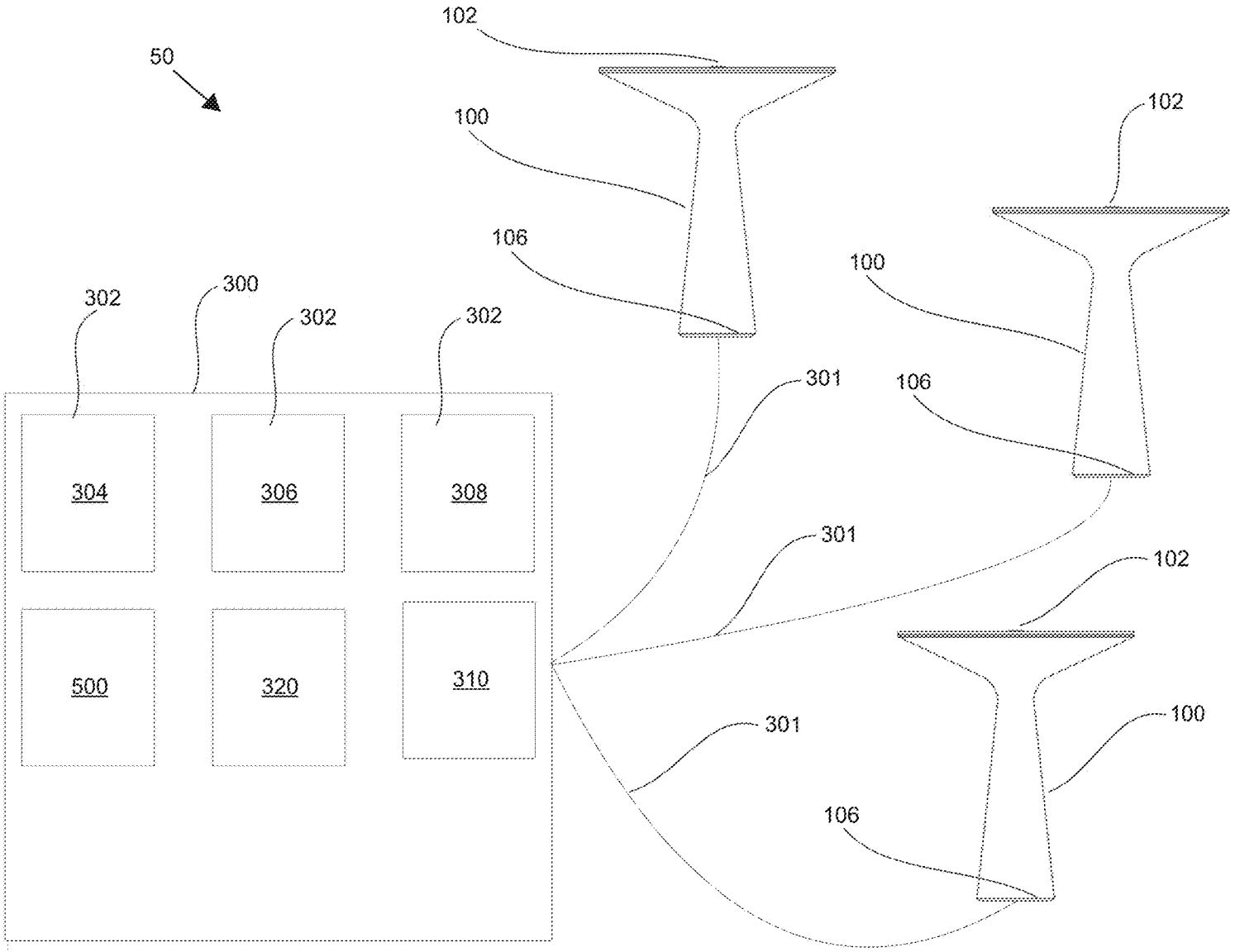
FIG. 7 illustrates an embodiment of a dispensing system according to aspects of the disclosure.

As described above, the dispensing system 50 may be a modular system having a plurality of dispense locations 100 connected to a central, remote ingredient system 300. Referring to FIG. 7, a dispensing system 50 may be provided comprising a one or more dispense locations 100, and an ingredient system 300 located remotely from the dispense locations 100. Piping 301 may extend from the ingredient system 300 to the dispense locations 100.

Referring to FIG. 7, the ingredient system 300 may have a plurality of sources of beverage ingredients. The ingredient system 300 may comprise a plurality of highly concentrated ingredients for preparation of a wide variety of beverages. Each beverage ingredient 302 may be stored in a storage container and/or controlled by the ingredient system. The storage containers may comprise cartridges, bags, or bag-in-box type containers, and any other suitable storage container. The beverage ingredients 302 may include soft drink syrup 304, and flavor ingredients 306. Beverage ingredients may also include water or carbonated water 308. Syrups and other beverage ingredients may include any of those provided by PepsiCo Inc. to form beverages known under any PepsiCo branded name, such as Pepsi-Cola®. Syrup and other beverage ingredients may be pumped from the storage containers or other supply containers by pumps to dispense locations 100 as desired. In addition to those beverage ingredients listed above any other number of beverage ingredients may be included such as water, milk etc.

As described above, a bag-in-a-box (BiB) may be used in some embodiments to provide beverage ingredients, such as soft drink syrup, to the dispense locations 100. In some embodiments, multiple BiB may be stacked or placed on rack. In some embodiments, BiB may include a bag or bladder, composed of plastic or metalized film within a corrugated fiberboard box. In some embodiments, the dispensing system 50 may include an electronic level sensor to determine the level of contents within the bladder.

The ingredient system 300 may also include one or more pump assemblies 310 used to pump beverage ingredients 302 from the ingredient system 300 through piping 301 to the dispense location(s) 100 and/or dispensing head(s) 102. Pump assemblies 310 may also be used to pump other liquids through the piping 301 to the dispensing head(s) 102 such was cleaning solutions. The pump assemblies may be driven by $CO_2$ from a tank and supplied through a $CO_2$ gas branch line. These pumps may comprise conventional syrup pumps, e.g., BIP pumps.

The ingredient system may include other systems including, for example, ingredient treatment systems 320. The ingredient treatment system 320 may be used to treat the ingredients 302. For example, ingredient treatment system 320 may be used to cool ingredients 302 to a desired temperature for a cold beverage and/or may be used to heat ingredients to a desired temperature for hot beverages. Ingredient temperature ranges provided by ingredient treatment system(s) may be from just below about freezing (e.g., to create or prepare a slurry or slush product) through about 180 degrees Fahrenheit (e.g. to create or prepare a hot beverage, such as a coffee or tea).

The ingredient treatment system 320 may also be any suitable treatment system that may improve taste, reduce odor, and/or reduce chlorines. The ingredient treatment system, may, for example, be a water treatment system that may improve water quality to near pure water through systems, including but not limited to reverse osmosis (RO). Treated ingredients, including water, from the ingredient treatment system(s) 320 may be provided to dispense location 100.

Figure 8:
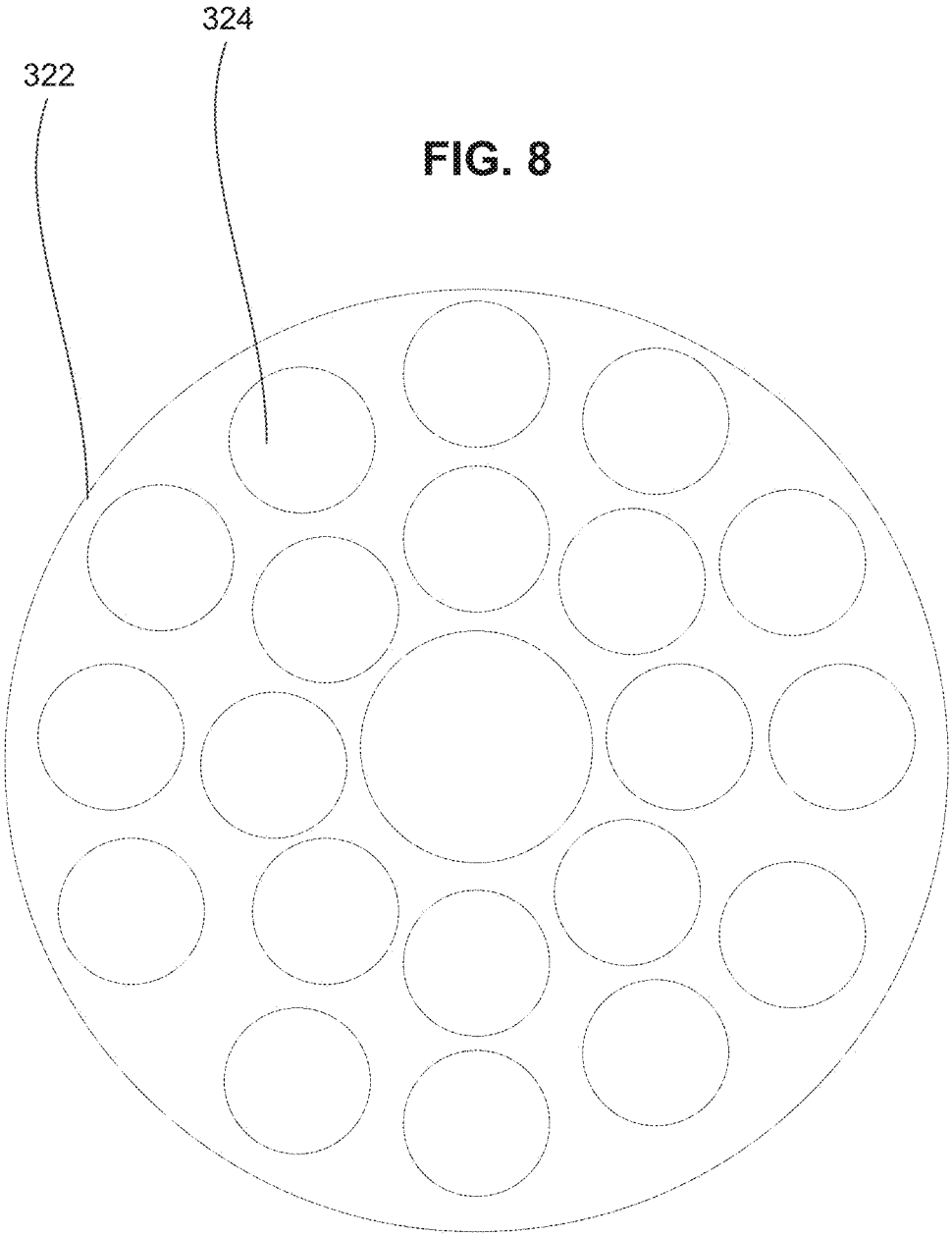
FIG. 8 is a cross-sectional schematic view of piping for use with a dispensing table according to aspects of the disclosure.

As shown in FIG. 8, piping or main micro bundle 301 comprises an outer pipe 322, and bundle of smaller inner pipes 324. Inner pipes 324 may comprise any beverage ingredient including beverage/syrup lines, flavoring lines, and water and carbonated water lines.

The piping 301 may also include a return line or water return line. The return line may, for example, allow for the circulating of water that is not dispensed from a dispensing head 102 to be returned to ingredient system 300.

The dispensing system 50 may also include a local dairy and/or juice system. Thus, a beverage may be prepared with a shot of juice, e.g., a cola with a shot of lemon juice and/or lime juice. A beverage, such as a cool frappuccino or hot coffee, may be prepared with a shot of a dairy product, e.g., milk or cream.

The dispensing system 50 allows for the adding of additional dispensing heads 102 to a system while still using the ingredient system 300.

In other embodiments, the dispensing system 50 may be substantially self-contained wherein one or more beverage ingredients are contained within the dispense location 100. In such systems all or substantially all of the beverage ingredients may be contained within cartridges or other containers within the base. In some embodiments, some beverage ingredients such as water may not be stored within the dispense location 100 and instead may include a water line.

The dispensing system 50 may comprise auto sanitizing systems. Those skilled in the art will recognize that locking of a portion of the system may be used so that a sanitizing cycle may be run. For example, a lock out feature with recognition of the sanitizer may be provided to prevent unintentional beverage dispensing. The lock out feature with recognition of the sanitizer may have mechanical and electrical safety redundancy.

The dispensing system 50 may comprise interlocks on flavor types.

The dispensing system 50 may comprise and/or communicate with a social media system or application. For example, when a mobile device of a consumer is within a predetermined distance from a sensor linked to the modular dispensing system, a message may be sent to the consumer's mobile device that queries the consumer whether the consumer would like to purchase a beverage. Alternatively, or at the same time, a message may appear at a dispense location 100 that queries the consumer whether the consumer would like to purchase a beverage. The social media system or application may download to the dispensing system 50 the preference or preferences of a consumer based on the consumer's past purchases and/or identified preferences. Thus, the dispensing system 50 and/or the social media system or application may query a particular consumer when a mobile device of a consumer is within a predetermined distance from a sensor of the modular dispensing system.

The dispensing system 50 may also receive a beverage order from a consumer via a social media system or application, including but not limited to the social media system or application of a seller of beverages, including but not limited to restaurants, theaters, other entertainment venues, and manufacturers and/or distributors of beverages. A consumer may order a beverage prior to arriving at dispense location 100 so that the drink may be prepared and placed in a container by the time or close to the time the consumer arrives at the dispense location 100. Alternatively, a container having an identifier 251 may be prepared and made available to the consumer for filling by the time or close to the time the consumer arrives at the dispense location 100.

Thus, the system may recognize an individual and make certain decisions regarding what beverage(s) or type of beverage(s) to offer the individual. The system may change what the system traditionally offers if such a beverage has been ordered by the individual in the past, or the individual has identified the beverage as a preference on social media system or application.

In some embodiments, the dispensing system 50 may be associated with a mobile application. In some embodiments, the mobile application may be executed on a mobile device, such as a mobile phone, tablet computer, laptop, etc. The mobile application may allow user selection of beverages for dispensing via the dispense location 100. Communication between the mobile application and beverage dispense location 100 may be via any supported wireless means, such as infrared, Wi-Fi or Bluetooth, among others.

In addition, the system may handle gifts or promotions given from one entity to another. By way of example, but not limitation, the system may recognize an individual, determine whether that individual has received a gift or is eligible for a promotion, and send a query to the individual as to whether the individual will accept the gift or promotion, such as a free beverage or a beverage at a reduced price.

The system may also provide a sanitizing screen display, including but not limited to, a puff of steam, a wiping motion display, and ultraviolet LED.

The system may provide a user with variable pricing based on brands being sold, e.g., the system may determine what products a user may receive based on cup size.

Some embodiments may include a dispensing system for bottom filling a container with a beverage, the dispensing system including a controller configured to receive a beverage order from a user and make available a container including an identifier based on the beverage order received from the user; a table including a top surface, an ingredient conduit disposed below the top surface and including a plurality of ingredient lines, a dispensing head configured to sealingly engage a recessed portion on the bottom of the container, the dispensing head including one or more outlets for dispensing one or more ingredients received from the one or more ingredient lines into the bottom portion of the container, and a sensor configured to detect the presence of the identifier on the container when the container is sealingly engaged with the dispensing head; and the controller is configured to bottom fill the container with the beverage when the sensor detects the identifier on the container sealingly engaged with the dispensing head.

In any of the various embodiments discussed herein, a sensor of a dispensing system may be selected from the group of: a capacitance sensor, a radio-frequency identification (RFID) sensor, an electronic sensor configured to read a conductive ink label, and a combination thereof.

In any of the various embodiments discussed herein, an identifier on a container may be selected from the group of: a radio-frequency identification (RFID) tag, a conductive ink label, and a combination thereof. In any of the various embodiments discussed herein, a conductive ink label may be unreadable by the sensor when exposed to moisture. In any of the various embodiments discussed herein, a dispensing system may be configured not to bottom fill a container having an identifier that cannot be read by a sensor.

In any of the various embodiments discussed herein, a table may include a table top defining the top surface of the table and a support structure for supporting the table top.

In any of the various embodiments discussed herein, a dispensing system may include a user interface configured to receive a user's selection of one or more different types of beverages to be dispensed via a dispensing head. In any of the various embodiments discussed herein, a dispensing system may include a plurality of user interfaces configured to receive a user's selection of one or more different types of beverages to be dispensed via a dispensing head. In any of the various embodiments discussed herein, a dispensing system may include a plurality of user interfaces disposed radially around a dispensing head on a table.

In any of the various embodiments discussed herein, a dispensing system may include a plurality of tables, each table including a dispensing head, an ingredient conduit coupled to the dispensing head, and a sensor configured to detect the presence of an identifier on a container when the container is sealingly engaged with the dispensing head of that table and a controller may be configured to bottom fill containers with a beverage via dispensing heads at each table when the sensor of that table detects an identifier on a container sealingly engaged with the dispensing head of that table.

In any of the various embodiments discussed herein, a dispensing head may include a first outlet, a second outlet arranged vertically above the first outlet, and a third outlet arranged vertically above the second outlet, and a dispensing platform may be configured to rinse the dispensing head by dispensing carbonated or non-carbonated water from the third outlet of the dispensing head after the container is disengaged from the dispensing head.

In any of the various embodiments discussed herein, a controller may be configured to receive a beverage order from a user via a social media system.

Some embodiments may include a dispensing platform for bottom filling a container with a beverage, the dispensing platform including a top surface; an ingredient conduit disposed below the top surface and including a plurality of ingredient lines; and a dispensing head coupled to the ingredient conduit and extending vertically above the top surface, the dispensing head including a plurality of outlets for dispensing one or more ingredients received from one or more ingredient lines into a bottom portion of the container, where the outlets are arranged vertically on the dispensing head and each of the plurality of ingredient lines is in fluid communication with one of the outlets of the dispensing head.

In any of the various embodiments discussed herein, a dispensing head may include a first outlet, a second outlet arranged vertically above the first outlet, and a third outlet arranged vertically above the second outlet. In any of the various embodiments discussed herein, the third outlet may be coupled to an ingredient line that is coupled to a source of carbonated or non-carbonated water. In any of the various embodiments discussed herein, the first outlet may be coupled to an ingredient line that is coupled to a first ingredient source, the second outlet may be coupled to an ingredient line that is coupled to a second ingredient source, and the third outlet may coupled to an ingredient line that is coupled to a third ingredient source. In any of the various embodiments discussed herein, the first ingredient source may be a source of flavoring, the second ingredient source may be a source of syrup, and the third ingredient source may be a source of water.

In any of the various embodiments discussed herein, an uppermost outlet of a plurality of outlets on a dispensing head may be coupled to an ingredient line that is coupled to a source of carbonated or non-carbonated water and may be configured to rinse the dispensing head by dispensing carbonated or non-carbonated water.

Some embodiments may include a dispensing platform for bottom filling a container with a beverage, the dispensing platform including a top surface; a mixing chamber disposed below the top surface; a dispensing head coupled to the mixing chamber and extending vertically above the top surface, the dispensing head including an outlet for dispensing the beverage into a bottom portion of the container; and an ingredient conduit including a plurality of ingredient lines for delivering ingredients for forming the beverage to the mixing chamber, where the ingredients for the beverage are mixed in the mixing chamber before the beverage is dispensed from the dispensing head.

In any of the various embodiments discussed herein, a dispensing platform may be configured to rinse a mixing chamber by pumping carbonated or non-carbonated water through the mixing chamber. In any of the various embodiments discussed herein, a mixing chamber may include a drain for draining the mixing chamber of carbonated or non-carbonated water.

Some embodiments may include a dispensing system for bottom filling a container with a beverage, the dispensing system including a table; a dispensing head disposed on the table and configured to sealingly engage a recessed portion on the bottom of the container, the dispensing head including one or more outlets for dispensing one or more ingredients into the bottom portion of the container; a plurality of user interfaces configured to receive a user's selection of one or more different types of beverages to be dispensed via the dispensing head; and a controller configured to receive the user's selection of one or more different types of beverages to be dispensed via the dispensing head and dispense the one or more different types of beverages from the dispensing head.

In any of the various embodiments discussed herein a dispensing system may include a plurality of user interfaces disposed radially around a dispensing head on a table.

The invention(s) herein have been described and illustrated with reference to the embodiments of the figures, but it should be understood that the features of the invention(s) are susceptible to modification, alteration, changes or substitution without departing significantly from the spirit of the invention(s). For example, the dimensions, number, size and shape of the various components may be altered to fit specific applications. Accordingly, the specific embodiments illustrated and described herein are for illustrative purposes only and the invention(s) are not limited except by the following claims and their equivalents.

What is claimed is:

1. A dispensing system for bottom filling a container with a beverage, the dispensing system comprising:

a controller configured to receive a beverage order from a user;

a table comprising:

a table top having a top surface, and a support structure that supports the table top, an ingredient conduit disposed below the top surface, the ingredient conduit comprising a plurality of ingredient lines, a dispensing head configured to sealingly engage a recessed portion on a bottom portion of the container, the dispensing head comprising one or more outlets for dispensing one or more ingredients received from the plurality of ingredient lines into the bottom portion of the container, and a sensor configured to detect an identifier on the container when the container is sealingly engaged with the dispensing head;

wherein the controller is configured to bottom fill the container with the beverage when the sensor detects the identifier on the container sealingly engaged with the dispensing head, wherein the dispensing head comprises a first outlet, a second outlet arranged vertically above the first outlet, and a third outlet arranged vertically above the second outlet, and wherein the third outlet is in communication with a source of carbonated or non-carbonated water and is configured to rinse the dispensing head by dispensing the carbonated or non-carbonated water from the third outlet after the container is disengaged from the dispensing head.

2. The dispensing system of claim 1, wherein the sensor is selected from the group consisting of: a capacitance sensor, a radio-frequency identification (RFID) sensor, an electronic sensor configured to read a conductive ink label, and a combination thereof.

3. The dispensing system of claim 1, wherein the identifier is selected from the group consisting of: a radio-frequency identification (RFID) tag, a conductive ink label, and a combination thereof.

4. The dispensing system of claim 3, wherein the identifier is a conductive ink label, and the conductive ink label becomes unreadable by the sensor when exposed to moisture.

5. The dispensing system of claim 1, wherein the dispensing system is configured not to bottom fill a container having an identifier that cannot be read by the sensor.

6. The dispensing system of claim 1, further comprising a user interface configured to receive a user's selection of one or more different types of beverages to be dispensed via the dispensing head.

7. The dispensing system of claim 1, further comprising a plurality of user interfaces configured to receive a user's selection of one or more different types of beverages to be dispensed via the dispensing head.

8. The dispensing system of claim 7, wherein the plurality of user interfaces are disposed radially around the dispensing head on the table.

9. The dispensing system of claim 1, comprising a plurality of tables, each table comprising a dispensing head, an ingredient conduit coupled to the dispensing head, and a sensor configured to detect the presence of an identifier on a container when the container is sealingly engaged with the dispensing head of that table;

wherein the controller is configured to bottom fill containers with a beverage via the dispensing heads at each table when the sensor of that table detects an identifier on a container sealingly engaged with the dispensing head of that table.

10. The dispensing system of claim 1, wherein the controller is configured to receive the beverage order from the user via a social media system.

11. A dispensing platform for bottom filling a container with a beverage, the dispensing platform comprising:

a top surface;

an ingredient conduit disposed below the top surface, the ingredient conduit comprising a plurality of ingredient lines; and a dispensing head coupled to the ingredient conduit and extending vertically above the top surface, the dispensing he ad comprising a plurality of outlets for dispensing one or more ingredients received from the plurality of ingredient lines into a bottom portion of the container, wherein the plurality of outlets comprises a first outlet, a second outlet arranged vertically above the first outlet, and a third outlet arranged vertically above the second outlet, wherein each of the plurality of ingredient lines is in fluid communication with one of the plurality of outlets of the dispensing head, and wherein the third outlet is coupled to an ingredient line that is coupled to a source of carbonated or non-carbonated water.

12. The dispensing platform of claim 11, wherein the first outlet is coupled to an ingredient line that is coupled to a first ingredient source, and the second outlet is coupled to an ingredient line that is coupled to a second ingredient source.

13. The dispensing platform of claim 12, wherein the first ingredient source is a source of flavoring, and the second ingredient source is a source of syrup.

14. The dispensing platform of claim 11, wherein the third outlet is configured to rinse the dispensing head by dispensing carbonated or non-carbonated water.

15. A dispensing system for bottom filling a container with a beverage, the dispensing system comprising:

a table comprising a table top with a top surface, and a support structure that supports the table top;

a dispensing head disposed on the table and configured to sealingly engage a recessed portion on a bottom portion of the container, wherein when the dispensing head is engaged with the container, the dispensing head displaces an engagement surface of the container so as to create a flow path into the container, wherein the dispensing head comprising a plurality of outlets for dispensing one or more ingredients into the bottom portion of the container, and wherein the plurality of outlets comprises a first outlet, a second outlet arranged vertically above the first outlet, and a third outlet arranged vertically above the second outlet, and wherein the third outlet is coupled to a source of water or non-carbonated water;

a plurality of user interfaces disposed on the table top and configured to receive a user's selection of one or more different types of beverages to be dispensed via the dispensing head; and a controller configured to receive the user's selection of one or more different types of beverages to be dispensed via the dispensing head and dispense the one or more different types of beverages from the dispensing head.

16. The dispensing system of claim 15, wherein the plurality of user interfaces are disposed radially around the dispensing head on the table.

17. The dispensing system of claim 1, further comprising a container having a recessed portion on a bottom portion of the container, and an identifier configured to be detected by the sensor of the table.

18. The dispensing system of claim 17, wherein the container comprises an aperture on the recessed portion configured to receive the dispensing head.

19. The dispensing system of claim 15, wherein the top surface of the table comprises a declined surface having a drain at a bottom of the declined surface.

20. The dispensing system of claim 1, wherein the outlets are arranged on a lateral surface of the dispensing head.

* * * * *